United States Patent [19]

Robb

[11] Patent Number: 4,826,405

[45] Date of Patent: May 2, 1989

[54] FAN BLADE FABRICATION SYSTEM

[75] Inventor: Neil E. Robb, Jackson, Mich.

[73] Assignee: Aeroquip Corporation, Jackson, Mich.

[21] Appl. No.: 208,725

[22] Filed: Jun. 20, 1988

Related U.S. Application Data

[60] Division of Ser. No. 787,041, Oct. 15, 1985, abandoned, which is a continuation of Ser. No. 13,155, Feb. 10, 1987.

[51] Int. Cl.[4] ..... F04D 29/34

[52] U.S. Cl. ..... 416/204 R; 416/223 R; 416/DIG. 3

[58] Field of Search ..... 416/204 R, 214 R, 223 R, 416/237, 244, DIG.3

[56] References Cited

U.S. PATENT DOCUMENTS

| | | | |
|---|---|---|---|
| 2,581,872 | 1/1952 | Morrison | 170/173 |
| 2,952,902 | 9/1960 | Mora | 29/156.8 |
| 3,659,959 | 5/1972 | Holstrom | 416/212 |
| 3,733,147 | 5/1973 | Felker | 416/214 |
| 4,142,844 | 3/1979 | Brattstrom | 417/423 |
| 4,249,861 | 2/1981 | Charles | 416/132 A |

FOREIGN PATENT DOCUMENTS

| | | | |
|---|---|---|---|
| 492801 | 9/1938 | United Kingdom | 416/214 |

*Primary Examiner*—Robert E. Garrett
*Assistant Examiner*—John T. Kwon
*Attorney, Agent, or Firm*—Beaman & Beaman

[57] ABSTRACT

A system for fabricating fan blades wherein the assembly includes a flat hub plate having generally radially oriented notches defined therein intersecting the plate periphery. Individual blades each include a hub connection portion adjacent an inner end region which includes parallel flat portions angularly related to the general blade configuration interconnected by a transition portion. The flat blade portions are located upon opposite sides of the hub plate and the transition portion extends through the hub plate notch. The flat portions are attached to the hub plate, and by predetermining the position of the hub connection configuration on the blade, the fan characteristics can be predetermined and accurately duplicated. The system permits a standard set of tools to form a variety of sizes of fan blade components having various characteristics.

3 Claims, 3 Drawing Sheets

FAN BLADE FABRICATION SYSTEM

This is a division of application Ser. No. 787,041, filed Oct. 15, 1985 now abandoned, which is a continuation of Ser. No. 07/013,155 filed on Feb. 10, 1987.

BACKGROUND OF THE INVENTION

In the construction and design of air handling fans of the bladed type, the characteristics of the blade must be closely matched to the associated electric motor if optimum efficiency is to be attained. The diameter of the fan blades, their number, the pitch and configuration of the blades', rate of rotation, and other factors determine the "load" produced by the fan during operation, and if the fan motor is undersized for the load produced the motor will overheat and prematurely fail. Conversely, if the motor is larger than required, energy is wasted and the cost of manufacture unnecessarily increased.

The manufacturer of a wide variety of fans for various purposes must custom design each fan size for each purpose and capacity of air flow, and endeavor to obtain an electric drive motor which is most suitable for that particular fan. Often, a larger size motor than optimum must be purchased because of the unavailability of the proper size motor, and a large inventory of blade forming tools must be manufactured as each blade size will require its own special forming tools.

Basically, an air handling fan consists of a hub from which a plurality of blades radially extend. The hub and blades may be homogeneous wherein the entire blade is formed by a casting or molding operation using metal or synthetic material. Larger sizes of fans employ steel hubs and blades wherein the blades are separately affixed to the hubs.

In the conventional assembly of metal hubs and blades, a wide variety of interrelationships between the hub and blades may exist. For instance, the hub may include radially extending stubs which are twisted with respect to the plane of the hub and the blades are affixed thereto by rivets, or the like. Another means for attaching blades to a hub may be to angularly configure the inner end of the blade and directly affix the blade to the hub front side by rivets. In such instance, the blade pitch being determined by the angular relationship of the blade inner end to the hub.

Conventional systems for affixing blades to hubs require special tooling for each blade assembly and the necessary investment in tooling limits the size and capacity of fans offered by a given manufacturer, and as mentioned above, renders it difficult to provide an optimum match between the drive motor and blade assembly.

It is an object of the invention to provide a fan blade fabrication system wherein a variety of blade sizes can be formed from a set of standard tools thereby significantly reducing the tooling investment with respect to known fan fabrication techniques.

Another object of the invention is to provide a fan blade fabrication system which is of low cost and permits the physical characteristics of the fan to be very accurately predetermined permitting the optimum matching with an electric drive motor for achieving the highest efficiencies for moving air with respect to energy consumption.

Another object of the invention is to provide a fan blade fabrication system utilizing a standard set of tools wherein the characteristics of the fan can be predetermined and accurately duplicated, and wherein the fan characteristics may be accurately predetermined.

In the practice of the invention, a flat hub plate is employed having a hub boss affixed thereto whereby the hub may be mounted upon an electric motor shaft. The hub plate includes a plurality of generally radially oriented notches which have been pierced from the plate and intersect the plate circular periphery. Also, a plurality of rivet receiving holes are formed in the plate adjacent the notches for receiving the rivets used to attach the blades thereto.

The blades are formed of sheet metal and the blanks punched from flat stock. The blade blanks are placed within dies which impart a concave-convex configuration to the blade throughout its length, and the blade is of an elongated configuration including an outer end region and an inner end region to be attached to the hub plate. The blade inner end region includes a hub connection portion homogeneously defined of the blade sheet material and of a configuration distinctive from the blade's general transverse cross-sectional arcuate form.

The blade hub connection portion is of an elongated configuration and intersects the blade inner end and is parallel to the blade length. The hub connection portion includes a pair of elongated flat lands or sections which are angularly related to the general form of the blade and are parallel, but offset, with respect to each other and interconnected by an elongated transition portion transversely disposed to the lands. The extent of the offset corresponds to the thickness of the hub plate. When assembling the blade to the hub plate, the transition portion is received within a hub plate notch and one of the lands is located on one side of the hub plate, while the other land is located on the other hub plate side. Rivets extending through the lands and hub plate affix the blade and hub plate in assembled relation.

The angular relationship of the lands to the general blade configuration will be determined by the particular forming tools used, and by using three or four sets of tools having different land angles, a wide variety of fan characteristics can be achieved. Within a given set of tools the positioning of the blade blank therein will locate the hub connection portion as desired relative to the blade longitudinal axis, and by varying the location of the hub connection portion to the blade axis, the physical characteristics of the fan blade assembly can be changed as the projected width of the blades will vary as this dimension is regulated. Accordingly, a single set of tools may be used with a plurality of blade widths and lengths, and in addition to the change in blade characteristics by these factors, the positioning of the hub connection land surfaces on the blade inner end likewise will vary the blade operating characteristics.

As the reception of the blade transition portion within the hub plate notch tends to accurately orient the blade to the hub plate, and as the flat lands firmly engage the flat surfaces of the hub plate, a firm interconnection between the blades and the hub plate is achieved assuring consistent assembling and maximum strength. As the components of the blade assembly are economically manufactured, costs are reduced, and because of the versatility of determining the blade operating characteristics, the assembled blades may be closely matched with available electric motors produced at high production and low cost.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 6:
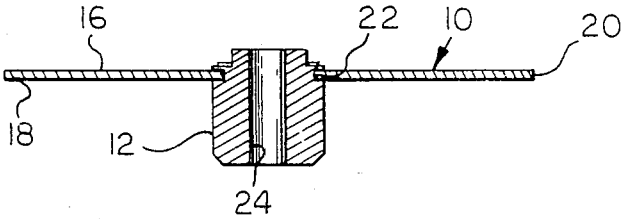
FIG. 6 is an elevational, sectional view taken along Section VI—VI of FIG. 5.

A fan assembly in accord with the invention basically includes a hub plate 10 having a central opening in which the hub 12 is mounted, FIG. 6, and a plurality of blades 14 are attached to the hub plate by rivets.

Figure 5:
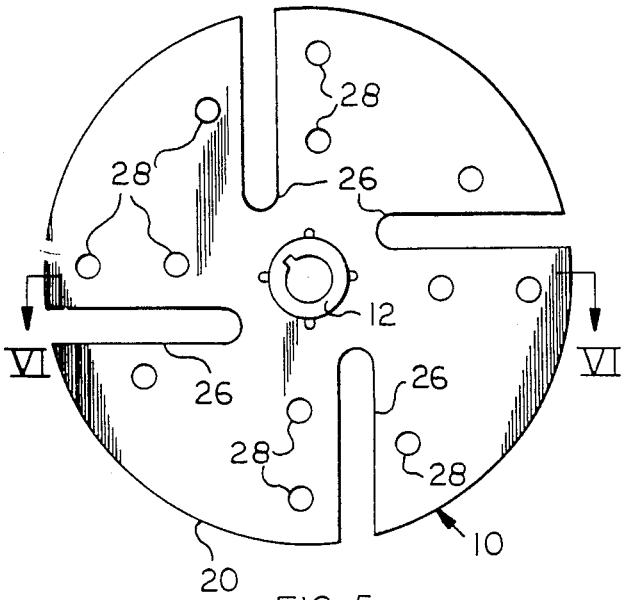
FIG. 5 is a plan view of a hub plate for a four-blade fan.

With reference to FIGS. 5 and 6, a hub and hub plate is shown for use with a four-blade assembly. The hub plate 10 is of a planar configuration having parallel front side 16 and rear side 18 and a circular periphery 20. A notched central opening 22 receives the hub 12 which is staked therein, and the hub includes a bore 24 usually having a keyway and set screw wherein the fan motor shaft, not shown, may be received therein and the hub and hub plate mounted upon the fan motor shaft.

Four notches 26 are defined in the hub plate 10 and are of elongated linear form and intersect the periphery 20. The notches 26 are not truly radial with respect to the center of the hub plate but are slightly offset as will be appreciated from FIG. 5. Holes 28 are also pierced in the hub plate, three holes being closely associated with each notch for receiving the blade rivets, as later described.

Figure 7:
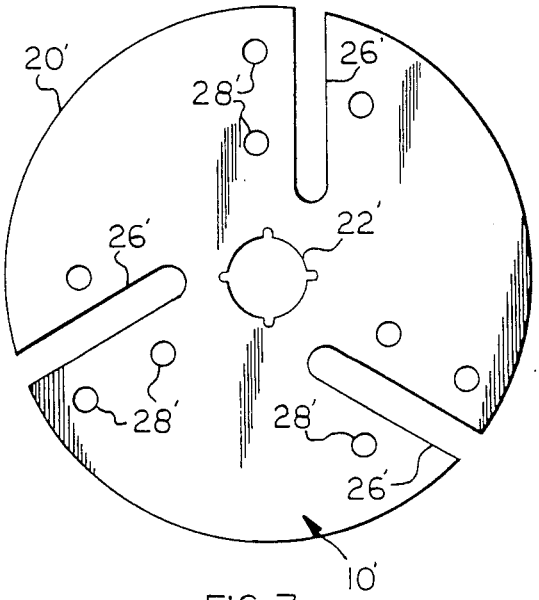
FIG. 7 is an elevational view of a hub plate for a three-blade fan assembly.

In FIG. 7 a hub plate 10' for use with a three-blade fan assembly is illustrated and in this figure comparable components to those previously described are indicated by primes.

The notches 26' are oriented at 120° intervals, rather than the 90° intervals of the embodiment of FIG. 5, and for purpose of illustration a hub is not shown installed in the central opening 22'. As will be noted, the notches 26' are also not truly radial, but slightly offset from the center of the opening 22'.

Figure 1:
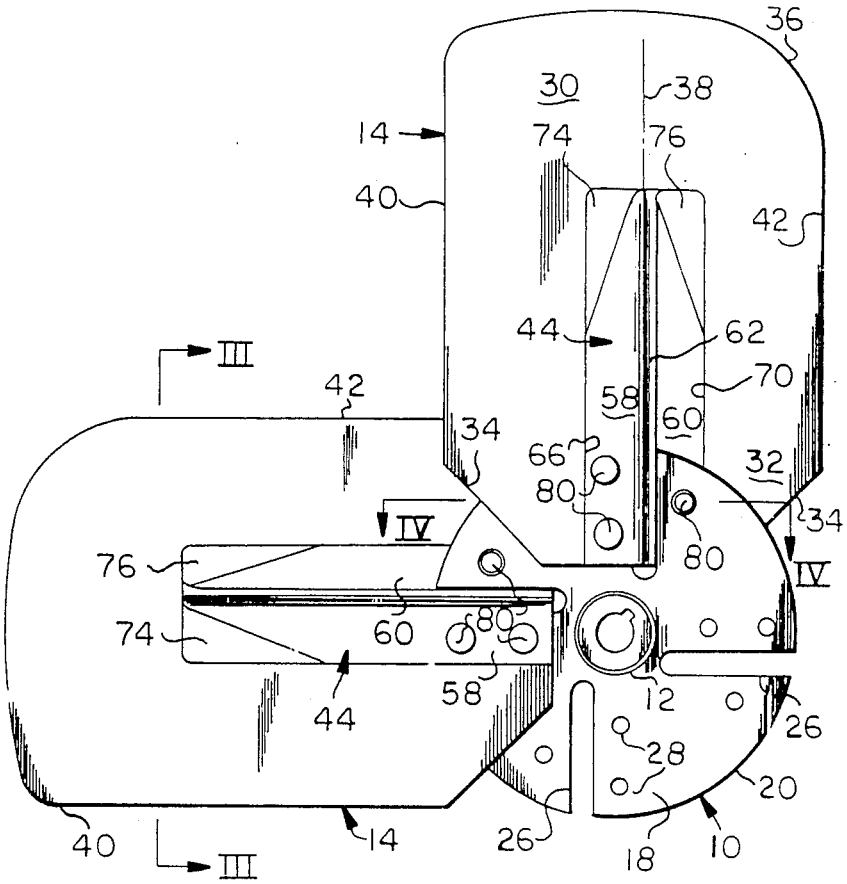
FIG. 1 is an elevational, rear view of a partial fan assembly in accord with the invention, two blades being attached to a hub plate capable of accommodating four blades.
Figure 3:
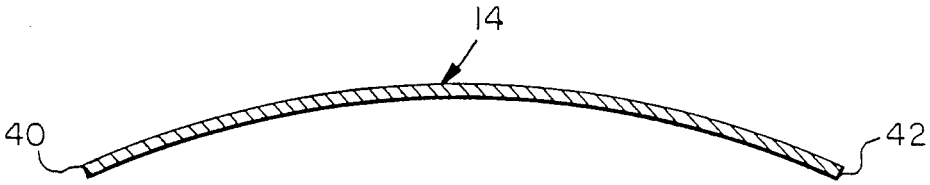
FIG. 3 is an elevational, sectional view taken through the fan blade outer region along Section III—III of FIG. 1.

The blades 14 are formed of sheet metal and are punched from flat stock to a configuration as will be appreciated from FIG. 1. The blades include an outer end region 30 and an inner end region 32. The inner end region is beveled at 34, and the blade outer end at its trailing edge is radiused at 36. The longitudinal axis of the blade is represented at 38, and the blade includes parallel forward and trailing edges 40 and 42, respectively.

Figure 8:
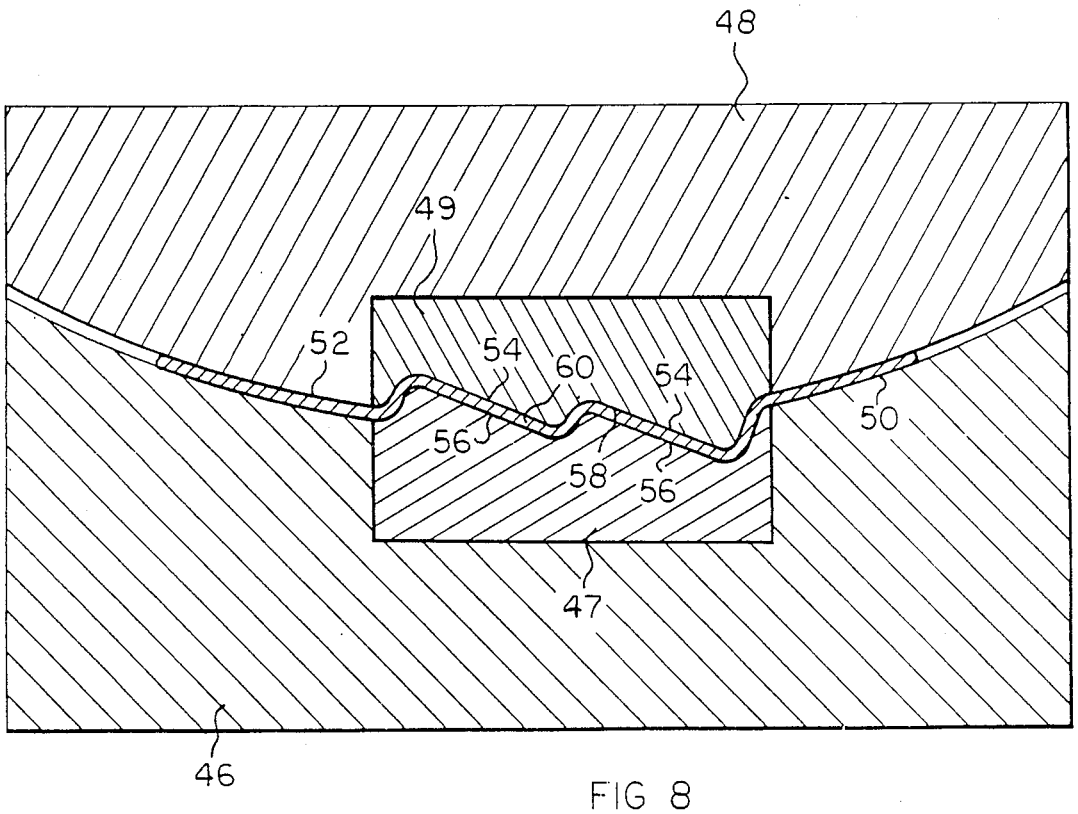
FIG. 8 is an elevational, sectional view taken through tooling used to form a blade in accord with the invention.

The hub connection portion of the blade is generally indicated at 44, and is formed simultaneously with the shaping of the entire blade after blanking. The flat blank is placed within a die set such as shown in FIG. 8 consisting of the lower die 46 and upper die 48, having inserts 47 and 49, respectively, and upon the closing of these dies, the blade will be shaped to a concave-convex configuration throughout its entirety, except for the hub connection portion 44. The die concave surface 50, and the die convex surface 52 will shape the blade general configuration and the die inserts include surfaces 54 and surfaces 56 for forming the hub connection portion surfaces as described below.

Figure 9:
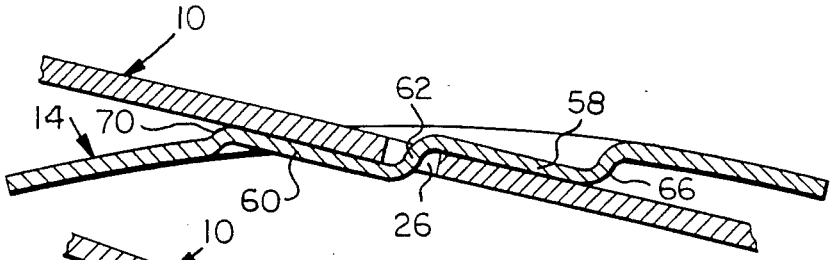
FIGS. 9, 10 and 11 are detail, elevational, sectional views taken through the hub plate and blade connection portion illustrating different angles of the hub connection lands.
Figure 10:
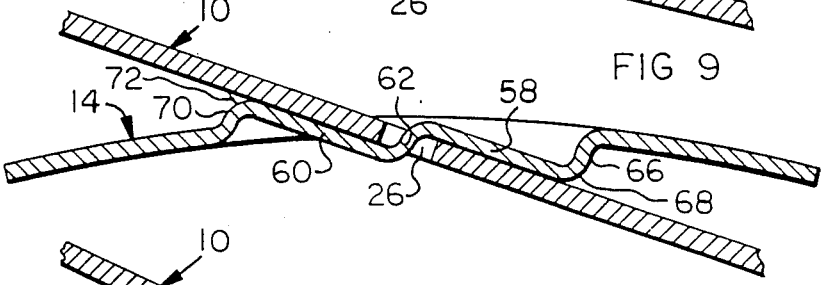
Figure 11:
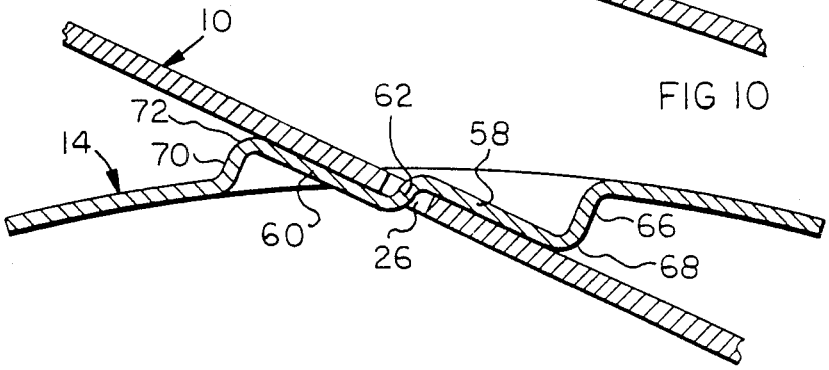

The hub connection portion 44 includes an elongated flat land or section 58, an elongated flat land or section 60 and the lands are interconnected by an elongated linear transition portion 62 which is formed by bends 64. The lands 58 and 60 are parallel to each other, but are offset by the portion 62 by a distance which corresponds to the thickness of the hub plate 10. The lands are angularly related to the general configuration of the blade, and the extent of this angular orientation will be determined by the configuration of the die surfaces 54 and 56. In FIGS. 9–11 three different extents of angular orientation are illustrated, FIG. 9 showing a 13° deviation, FIG. 10 a 19° and FIG. 11 a 25° relationship. The land 58 is connected to the portion 66, which is perpendicular to land 58, by a bend 68 and the portion 66 merges into the general blade configuration. Likewise, the portion 70 is connected to land 60 by bend 72 and portion 70 merges into the blade concave-convex shape. The transition portion 62 defines the central longitudinal axis of the hub connection portion 44 and the land 58 and portion 66 merge into the blade outer end region by transition portion 74, while portion 76 merges land 60 and portion 70 into end region 30.

Figure 2:
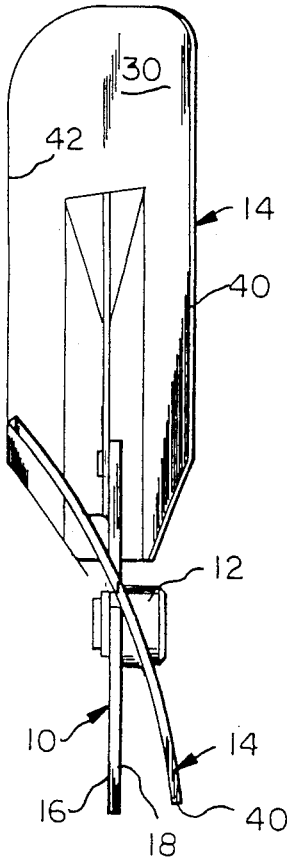
FIG. 2 is a side, elevational view as taken from the left of FIG. 1.
Figure 4:
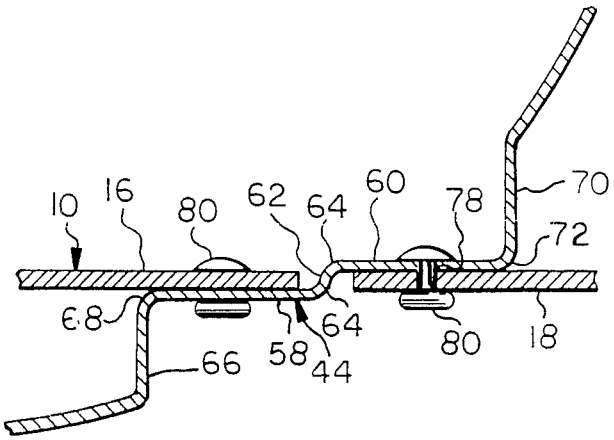
FIG. 4 is an enlarged, detail, sectional view taken through the hub plate along Section IV—IV of FIG. 1.

The blades 14 are assembled to the hub plate 10 in a manner which will be appreciated from FIGS. 1, 2 and 4. The transition portion 62 is received within a notch 26, and this relationship will permit the front side of land 58 to engage the rear side 18 of the hub plate, FIG. 4, and the rear side of the land 60 will engage the front side 16 of the hub plate. With respect to the above, it is to be noted that the front side of a land is the side disposed on the concave side of the blade, while the rear land side is disposed on the convex side of the blade. As the offset defined by the transition portion 62 is related to the thickness of the hub plate 10, the lands 58 and 60 will contiguously engage their associated hub plate surface in a parallel manner and holes 78 defined in the lands aligning with holes 28 receive the rivets 80 permitting the blades to be each firmly affixed to the hub plate at three locations. Of course, the number of blades attached to a hub plate corresponds to the number of notches 26 defined therein.

Figure 12:
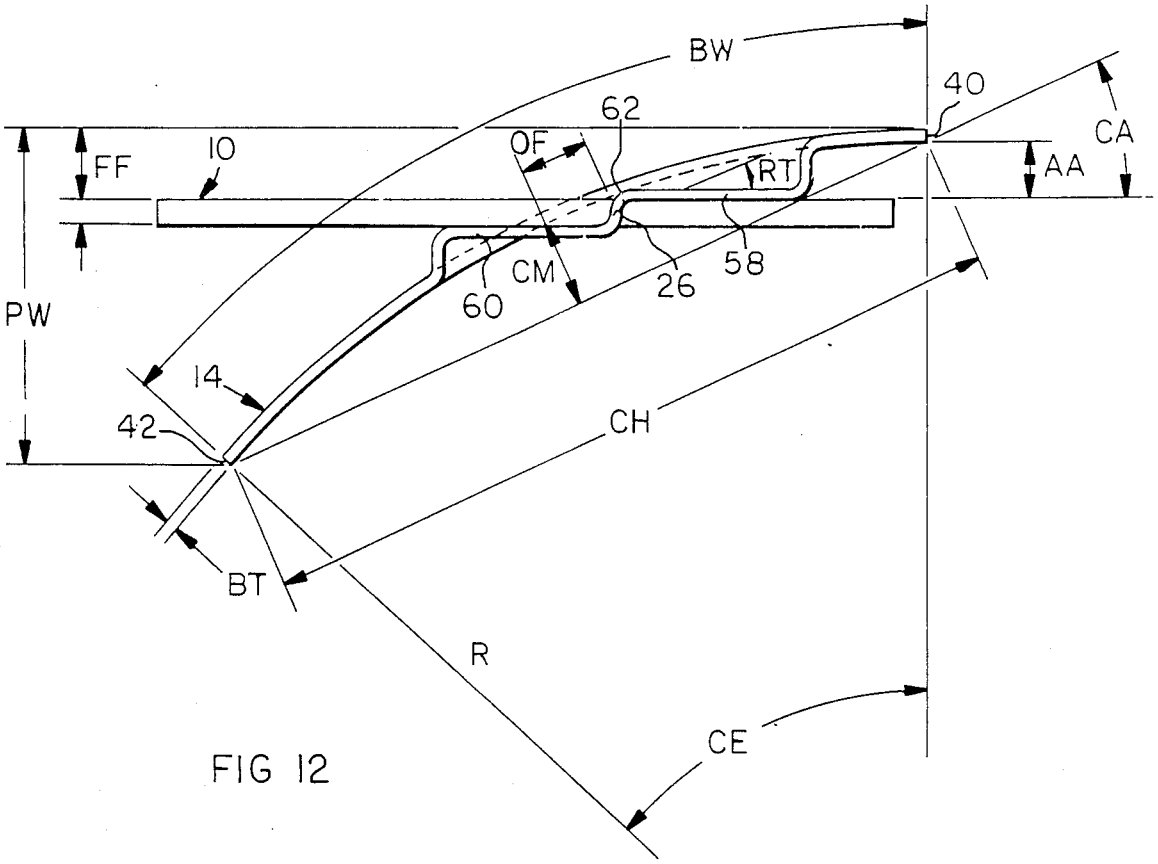
FIG. 12 is a detail, elevational, sectional view of a hub plate and blade generally similar to that shown in FIG. 4 illustrating the nomenclature used in the specification.

With reference to FIG. 12, the following nomenclature is employed:

PW = projected width

BW = blade width

R=blade radius
CA=chord angle
CE=central angle, included by the blade width and radius
CH=chord from edge to edge of the blade
CM=chamber from chord to deepest part of blade
AA=attack angle of leading edge of blade
OF=offset from center of blade to center of forming dies
BT=blade thickness
FF=front-to-front (leading edge of blade to closest face of disc)
RT=resultant twist from angle of blade form die The inventive concepts may be used to produce fans having diameters from 12" to 60" and the number of blades may vary from one to eight as mounted upon a common hub plate 10. The width of the blades may vary from approximately 1" to 6", or greater, and by varying the width and length, as well as the location of the hub connection portion 44 upon the blade, a wide variety of fans may be produced having a variety of operating characteristics For a given blade length and width, the power required to drive the fan, and the capacity of air movable thereby, may be varied by slightly changing the position of the hub connection portion 44 on the blade with respect to the blade longitudinal axis 38, i.e. the offset (OF). For instance, with reference to FIG. 12, if the lands 58 and 60 are moved to the left or right with respect to the blade leading edge 40 or trailing edge 42 the angle of attack AA will vary as will the projected width (PW) and the chord angle (CA) and change the amount of air being displaced by each blade. The adjustment of the position of the hub connection portion 44 relative to the blade longitudinal axis is readily varied by changing the positioning of the blade blank within the dies 46 and 48, and such positioning is determined by guide surfaces or pins, not shown, located in the dies, as is well known. .Thus, by moving the hub connection portion 44 closer to the blade leading edge 40 a greater volume of air will be displaced by each blade, and likewise, by moving the hub connection portion 44 toward the blade trailing edge 42, a lesser fan capacity, and energy requirement, results.

The different angular relationships shown in FIGS. 9–11 are produced by different forming die inserts, and a forming die insert set is chosen which will approximately produce the desired fan characteristics when the offset (OF) is at a minimum. Thus, only a few forming die insert sets are required to provide a very wide range of fan characteristics and the use of the invention substantially reduces tooling costs over known fan fabrication techniques where a die set is required for each type of fan blade desired. The use of die inserts 47 and 49 reduces the cost of the tooling, and by merely reversing the assembly of insert and die halves, i.e. placing insert 47 in die 48 and insert 49 in die 46, blades operable in clockwise or counterclockwise directions of rotation can readily be manufactured.

Because the configuration of the hub connection portion lends itself to a variety of blade widths and lengths, and as the association of the transition portion 62 within the notch 26 aids in orienting the blade to the hub plate 10 during assembly, the practice of the invention simplifies assembly and minmizes the likelihood of improper fabrication.

By locating the lands 58 and 60 on opposite sides of the hub plate 10 the forces exerted on the blade by centrifugal forces are effectively resisted and absorbed by the blade structure without producing localized stress points, and only minimal stress is placed upon the rivets 80, requiring only a few rivets for each blade. For instance, the centrifugal forces acting oh blade portions 66 and 70, FIG. 4, and the blade portions to the leading edge 40 and trailing edge 42, tend to deflect these portions toward the plane of the hub plate 10. However the forces on portion 66 only bias the land 58 into tighter engagement with the plate side 18 and the forces on portion 70 bias land 60 into tighter engagement with side 16, and the tendency for the blade to "pivot" about the central transition portion 62 is also resisted by the "flat" engagement of the lands to their associated hub plate side. The relatively large area of contact between the lands and hub plate reduces localized stress and gives the blade a "balanced" connection to the hub plate.

It is appreciated that various modifications to the inventive concepts may be apparent to those skilled in the art without departing from the spirit and scope of the invention.

I claim:

1. A fan blade assembly comprising, in combination, a flat hub plate having a central opening, a periphery, and front and rear sides, a plurality of elongated linear notches defined in said hub plate intersecting said sides and having a substantially uniform width, each notch having an inner end and an outer end intersecting said hub plate periphery, a plurality of sheet metal elongated blades mounted upon said hub plate, each blade having a central elongated axis, an outer end region, and inner end region, leading and trailing lateral edges, a thickness and a concave-convex transverse cross section in the direction of the thickness defined by a concave front side and a convex rear side, a homogeneous hub connection portion defined on said blade at said inner end region, said hub connection portion including flat first and second lands lying in separate planes angularly disposed to the concave-convex configuration of the blade, said first and second lands lying in parallel offset planes and interconnected by an elongated linear transition portion having a transverse cross section including arcuate bends blending said transition portion into said first and second lands, said lands being directly adjacent said transition portion, each land having a front surface disposed on said blade front side and a rear surface disposed on said blade rear side, said blade being mounted on said hub by said hub connection portion being mounted upon said hub plate wherein said transition portion extends through a notch whereby said first land rear surface engages said hub plate front side adjacent the associated notch and said second land front surface engages said hub plate rear side adjacent the associated notch, said notch having a width greater than the width of said transition portion whereby said transition portion including bends are located within the associated hub plate notch, and fastening means connecting said lands to said front plate.

2. In a fan blade assembly as in claim 1, said fastening means comprising rivets extending through said lands and said hub plate.

3. In a fan blade assembly as in claim 1, said transition portion being transversely disposed to the plane of said lands.

* * * * *

UNITED STATES PATENT OFFICE

CERTIFICATE OF CORRECTION

Patent No. 4,826,405 Dated May 2, 1989

Inventor(s) Neil E. Robb

It is certified that error appears in the above-identified patent and that said Letters Patent is hereby corrected as shown below:

On the title page in the identity of the Assignee, delete [Aeroquip Corporation] and insert -- Airmaster Fan Company --.

Signed and Sealed this

Ninth Day of January, 1990

*Attest:*

JEFFREY M. SAMUELS

*Attesting Officer*

*Acting Commissioner of Patents and Trademarks*